US011136176B2

(12) United States Patent
Almond et al.

(10) Patent No.: US 11,136,176 B2
(45) Date of Patent: Oct. 5, 2021

(54) CONTACT LENS BLISTER PACKAGE WITH LENS CRADLE

(71) Applicant: CooperVision International Limited, Fareham (GB)

(72) Inventors: Sarah Almond, Southampton (GB); Carlos Ortiz, Pittsford, NY (US); Gary Hunt, Bristol (GB); Mike Nelson, Bristol (GB); Russell Beard, Bristol (GB); Thomas Harkin, Bristol (GB); Pauline Gavelle, Toulouse (FR)

(73) Assignee: CooperVision International Limited, Fareham (GB)

( * ) Notice: Subject to any disclaimer, the term of this patent is extended or adjusted under 35 U.S.C. 154(b) by 77 days.

(21) Appl. No.: 16/737,944

(22) Filed: Jan. 9, 2020

(65) Prior Publication Data

US 2020/0231351 A1 Jul. 23, 2020

Related U.S. Application Data

(60) Provisional application No. 62/795,312, filed on Jan. 22, 2019.

(51) Int. Cl.
*B65D 75/32* (2006.01)
*B65D 83/00* (2006.01)

(52) U.S. Cl.
CPC ..... *B65D 75/326* (2013.01); *B65D 83/00* (2013.01); *B65D 2575/3245* (2013.01); *B65D 2585/545* (2013.01)

(58) Field of Classification Search
CPC ..... B65D 75/326; B65D 83/00; B65D 2575/3245; B65D 2585/545; B65D 2575/329; A61F 9/0061; A45C 11/005; A45C 11/006; A45C 11/046
USPC ..... 206/5.1
See application file for complete search history.

(56) References Cited

U.S. PATENT DOCUMENTS

| | | | |
|---|---|---|---|
| 4,691,820 | A | 9/1987 | Martinez |
| D299,085 | S | 12/1988 | Martinez |
| D305,478 | S | 1/1990 | Lahm et al. |
| 5,069,494 | A | 12/1991 | Reinson et al. |
| 5,409,104 | A | 4/1995 | Lovell |

(Continued)

FOREIGN PATENT DOCUMENTS

| | | | |
|---|---|---|---|
| AU | 739045 | B2 | 10/2001 |
| EP | 0734958 | A1 | 10/1996 |

(Continued)

OTHER PUBLICATIONS

International Search Report and Written Opinion issued in corresponding International Patent Application No. PCT/GB2020/050116 dated Apr. 3, 2020 (10 pages).

*Primary Examiner* — Chun Hoi Cheung
(74) *Attorney, Agent, or Firm* — Kilyk & Bowersox, P.L.L.C.

(57) ABSTRACT

A blister package for a contact lens is provided. The blister package includes a body defining a handle and a well, a flexible top contacting the body and closing the well, and a lens cradle that includes a lens support bowl. The lens cradle is attached to the inner surface of the flexible top. By peeling away the flexible top, the lens cradle is lifted away from the bottom surface of the well and the lens is raised out of the well, cradled by the lens support bowl, and presented for easy fingertip manipulation by a user.

18 Claims, 2 Drawing Sheets

(56) References Cited

U.S. PATENT DOCUMENTS

| | | | | |
|---|---|---|---|---|
| 5,515,964 | A * | 5/1996 | Bauman | A45C 11/005 206/210 |
| 5,609,246 | A | 3/1997 | Borghorst et al. | |
| 5,620,088 | A | 4/1997 | Martin et al. | |
| 5,685,420 | A | 11/1997 | Martin et al. | |
| 5,697,495 | A | 12/1997 | Abrams et al. | |
| 5,704,468 | A | 1/1998 | Lust et al. | |
| 6,044,966 | A | 4/2000 | Haase | |
| 6,260,695 | B1 | 7/2001 | Tasber et al. | |
| 6,398,018 | B1 | 6/2002 | Livesley et al. | |
| 6,471,052 | B2 | 10/2002 | Faxe et al. | |
| 6,474,465 | B1 | 11/2002 | Jux | |
| 6,572,165 | B2 | 6/2003 | Faxe et al. | |
| 6,889,825 | B2 | 5/2005 | Ichikawa et al. | |
| 6,997,344 | B2 | 2/2006 | Brown et al. | |
| 7,086,526 | B2 | 8/2006 | Newman | |
| 7,168,746 | B2 | 1/2007 | Py | |
| 7,426,993 | B2 | 9/2008 | Coldrey et al. | |
| 7,431,152 | B2 | 10/2008 | Marmo | |
| 7,477,366 | B2 | 1/2009 | Clements et al. | |
| 7,699,161 | B2 | 4/2010 | Tokarski et al. | |
| 7,770,732 | B2 | 8/2010 | Stroppolo et al. | |
| 7,784,608 | B2 | 8/2010 | Tokarski et al. | |
| 7,789,266 | B2 | 9/2010 | Biel et al. | |
| 7,816,455 | B2 | 10/2010 | Marmo | |
| 8,061,897 | B2 | 11/2011 | Ichikawa et al. | |
| 8,069,979 | B2 | 12/2011 | Newman et al. | |
| 8,281,920 | B2 | 10/2012 | Tokarski et al. | |
| 8,317,016 | B2 | 11/2012 | Tokarski et al. | |
| 8,459,445 | B2 | 6/2013 | Newman | |
| 8,833,548 | B2 | 9/2014 | Hsieh et al. | |
| 8,955,672 | B2 | 2/2015 | Newman | |
| 9,095,670 | B2 | 8/2015 | Briant et al. | |
| 9,119,450 | B2 | 9/2015 | Lee et al. | |
| 9,173,463 | B2 | 11/2015 | Clamp et al. | |
| 9,439,487 | B2 | 9/2016 | Barre et al. | |
| 9,655,423 | B1 | 5/2017 | Wang | |
| 9,701,458 | B2 | 7/2017 | Barrows et al. | |
| 9,839,270 | B2 | 12/2017 | Howell et al. | |
| D813,537 | S | 3/2018 | Miura et al. | |
| 10,092,075 | B2 | 10/2018 | Barre et al. | |
| 10,138,042 | B2 * | 11/2018 | Fawdington | A61F 9/0061 |
| 2005/0087453 | A1 * | 4/2005 | Mahieu | A61L 12/086 206/5.1 |
| 2006/0054514 | A1 | 3/2006 | Tokarski et al. | |
| 2006/0260957 | A1 | 11/2006 | Hamilton | |
| 2007/0119720 | A1 | 5/2007 | Marmo | |
| 2009/0139879 | A1 | 6/2009 | Tokarski et al. | |
| 2010/0300902 | A1 | 12/2010 | Marmo | |
| 2012/0055817 | A1 | 3/2012 | Newman et al. | |
| 2012/0267262 | A1 | 10/2012 | Wang et al. | |
| 2014/0027465 | A1 | 1/2014 | Howell et al. | |
| 2014/0246337 | A1 | 9/2014 | Newman | |
| 2014/0262845 | A1 | 9/2014 | Newman | |
| 2015/0114851 | A1 | 4/2015 | English et al. | |
| 2015/0150346 | A1 * | 6/2015 | Yasuda | A45C 11/005 206/5.1 |
| 2016/0198825 | A1 * | 7/2016 | Fawdington | A61F 9/0061 206/5.1 |
| 2017/0086552 | A1 | 3/2017 | Michalos | |
| 2017/0096272 | A1 | 4/2017 | Coon et al. | |
| 2017/0165901 | A1 | 6/2017 | Fischer et al. | |
| 2018/0125189 | A1 | 5/2018 | Barre et al. | |
| 2019/0008251 | A1 | 1/2019 | Kim | |
| 2020/0229560 | A1 * | 7/2020 | Almond | B65D 75/322 |

FOREIGN PATENT DOCUMENTS

| | | | |
|---|---|---|---|
| JP | 2008253746 | A | 10/2008 |
| JP | 5466344 | B1 | 4/2014 |
| JP | 5676760 | B2 | 2/2015 |
| JP | 2016221059 | A | 12/2016 |
| LU | 88593 | A1 | 9/1995 |
| WO | 2006105179 | A1 | 10/2006 |
| WO | 2009102273 | A1 | 8/2009 |
| WO | 2011112998 | A2 | 9/2011 |
| WO | 2012131786 | A1 | 10/2012 |
| WO | 2012168964 | A1 | 12/2012 |
| WO | 2013136361 | A1 | 9/2013 |
| WO | 2013153582 | A1 | 10/2013 |
| WO | 2014195588 | A1 | 12/2014 |
| WO | 2017137738 | A1 | 8/2017 |

* cited by examiner

CONTACT LENS BLISTER PACKAGE WITH LENS CRADLE

This application claims the benefit under 35 U.S.C. § 119(e) of prior U.S. Provisional Patent Application No. 62/795,312, filed Jan. 22, 2019, which is incorporated in its entirety by reference herein.

FIELD

The present invention relates to contact lens packaging and methods, and more specifically, to blister packages for sealed contact lenses containing unworn contact lenses, and methods of manufacturing contact lens packages.

BACKGROUND

Contact lenses, such as hydrogel and silicone hydrogel contact lenses, are frequently packaged in sealed blister packages or blister packs that permit storage of the unworn contact lenses in a sterile environment. For instance, a blister package which is adapted to provide a sterile sealed storage environment for a disposable or single-use hydrophilic contact lens, wherein the lens is immersed in a sterile aqueous solution, for example, such as in an isotonic saline solution, is described in Martinez, U.S. Pat. No. 4,691,820. Additional contact lens packages are disclosed in U.S. Pat. Nos. 4,691,820; 5,054,610; 5,337,888; 5,375,698; 5,409,104; 5,467,868; 5,515,964; 5,609,246; 5,620,088; 5,695,049; 5,697,495; 5,704,468; 5,711,416; 5,722,536; 5,573,108; 5,823,327; 5,704,468; 5,983,608; 6,029,808; 6,044,966; and 6,401,915.

As an example of part of a manufacturing process, a newly manufactured contact lens will be placed in a cavity or well of a plastic base member of a contact lens blister package, a contact lens packaging solution will be provided in the blister package cavity, and a foil sealing member will be adhered to the blister package to hermetically seal the contact lens in the packaging solution in the cavity. In other words, a contact lens blister package used in the manufacture of contact lenses contains a base member having a cavity or well, an unworn contact lens provided in a packaging solution within the cavity, and a sealing member sealed to the base member to provide an air tight seal around the perimeter of the cavity. The sealed blister package containing the contact lens is then autoclaved to sterilize the contact lens in the packaging solution in the cavity. The blister packs are understood to be primary packaging. Multiple blister packs are then placed in cartons. The cartons are considered secondary packaging.

Contact lens packages typically require a user to place a finger in a cavity or well to pinch or otherwise manipulate the contact lens, so it can be removed. The contact lens then needs to be positioned on a fingertip, so it can be placed on an eye. Handling the contact lens, however, can introduce contaminants to the surface of the lens which are then transferred to the eye. It can be appreciated that there remains a need to improve contact lens packaging, which, among other things, minimizes the need for touching the contact lens, or at least the concave surface of the lens, before the contact lens is placed onto a user's eye.

SUMMARY

The present invention addresses this need. As discussed herein, new contact lens packaging and methods of manufacturing packaged contact lenses are described. In general, as described herein, a contact lens package is provided. The contact lens package so described includes a base member and a sealing member coupled to the base member to seal a contact lens in a cavity formed between the base member and the sealing member. An unworn contact lens is provided in a contact lens packaging solution in the cavity. This sealed device is referred to herein as a sealed contact lens package or sealed contact lens blister package. The present contact lens package, when opened, presents the contact lens in an orientation and posture that facilitates the placement of the lens on a fingertip for easy transfer of the lens to the surface of the eye. No digging into a cavity or well or pinching of a sterile lens is required to place the lens in a desired orientation for placement onto an eye. Moreover, the present contact lens package, when opened, presents the lens in an orientation that does not require touching the inner, concave surface of the lens that, in use, directly contacts the surface of an eye.

According to an embodiment of the present invention, a blister package for a contact lens is provided, which comprises a body defining a handle and a well, a flexible top contacting the body and closing the well, and a lens cradle comprising a lens support bowl. The lens cradle is attached to the inner surface of the flexible top and, in use, is disposed between the bottom of the well and the flexible top. By peeling away the flexible top, the lens cradle is lifted away from the bottom surface of the well and the lens is raised out of the well, cradled by the lens support bowl. Lens solution can be drained back into the well through the lens support bowl, over an open lip of the lens support bowl, or both.

The lens cradle can comprise a tab attached to the inner surface of the flexible top by an adhesive bond, a heat-bond, or another type of bond. The lens support bowl moves with the flexible top due to the bonding of the lens cradle tab. The blister package is configured such that, by peeling the flexible top away from the body, the lens support bowl is lifted away from the bottom surface of the well and the contact lens supported in the lens support bowl is presented so it can be easily contacted with a fingertip. Lens solution can be drained back into the well through the lens support bowl, over an open lip of the lens support bowl, or both.

Other aspects and details of the present invention will be apparent based on the following drawings, detailed description, and claims.

DETAILED DESCRIPTION

Figure 1A:
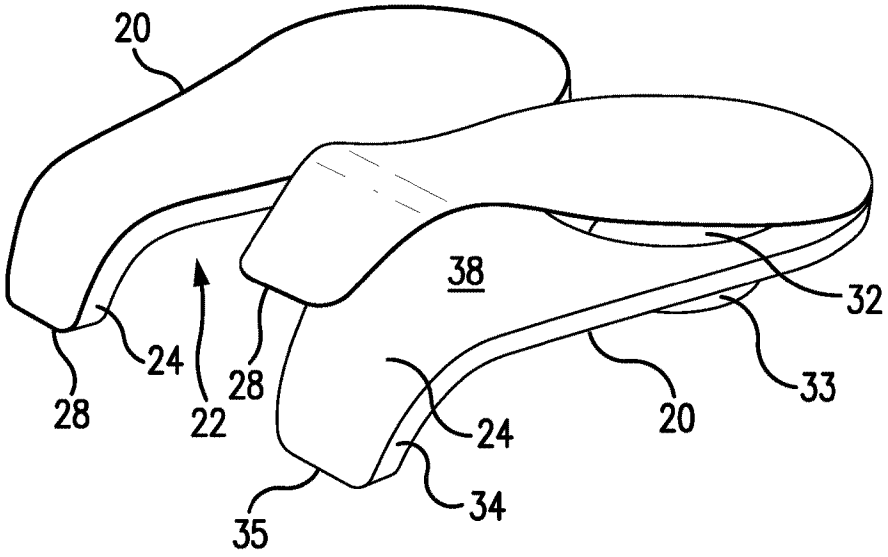
FIG. 1A shows two sequential steps involved with opening a blister package according to embodiments of the present invention.

The present invention provides a blister package for a contact lens. The blister package can comprise a body, a flexible top, and a lens cradle. The body has a body top surface and comprises a handle and a well connected to the handle. The well has a perimeter and an inner sidewall defining a bottom surface. The bottom surface can be flat or curved. The flexible top contacts the body top surface around the perimeter of, and closes, the well. The flexible top has an inner surface that can be adhered, heat-bonded, or otherwise attached to the body top surface to form a seal. The flexible top can also comprise a peel tab that can be peeled away from the body to open the well. The lens cradle is attached to the inner surface of the flexible top and comprises a lens support bowl. An opening can be provided along a side of the lens cradle between an edge of the lens support bowl and the inner surface of the flexible top. The lens support bowl can be shaped and sized to fit within the well. Once the blister package is sealed, the lens support bowl is positioned between the body and the flexible top. The blister package is configured such that, by peeling the flexible top away from the body to expose the well, the lens cradle is lifted away from the bottom surface of the well. Lens solution can be drained back into the well through the lens support bowl, over an open lip of the lens support bowl, through the opening to the lens support bowl, or a combination thereof.

The lens support bowl has an inner bowl surface, for example, a concave inner bowl surface. A cradle volume is defined between the inner bowl surface and the inner surface of the flexible top. The cradle volume is configured to accommodate a portion of a contact lens, for example, a major portion of a contact lens. The blister package can comprise a contact lens in the cradle volume.

The lens support bowl can comprise a plurality of drainage through-holes. Upon peeling-back the flexible top, contact lens solution in which the contact lens is immersed can drain through the through-holes and be caught in the well, without splashing, dripping, or spilling.

The lens cradle can comprise a tab portion attached to the lens support bowl and adhered to the inner surface of the flexible top. The tab portion can thus be attached to the inner surface of the flexible top and be lifted as the flexible top is lifted. The flexible top can be bent back also such that the lens in the lens cradle is even better more accessible.

The lens support bowl can have a rounded or concave shape, for example, a hollow, substantially hemispherical shape. The lens support bowl can have a shape defined by a portion of a hollow hemisphere. The lens support bowl can have a shape comprising from about 50% to about 75% of a hemisphere. The lens support bowl can have a concave shape that conforms to the shape of a contact lens. The inner bowl surface of the lens support bowl does not necessarily need to be concave. It can be shaped in any way that will catch the lens and present it to be picked by a hand of a user.

Each of the flexible top and the lens cradle can independently comprise a foil material, for example, a metal foil material such as an aluminum foil material. The flexible top can further comprise a peel tab that contacts the body on a first side of the well, and a hinge that is connected to the flexible top adjacent a second side of the well, the second side being opposite the first side. The peel tab can be in the form of a flap that can be grabbed to form a pull tab.

The present invention also provides a method that comprises placing a contact lens in the well of the blister package, in the lens cradle, and sealing the flexible top to the body to seal the well with the contact lens cradled therein. Subsequently, the method can further comprise opening the blister package by peeling away the flexible top and lifting the lens cradle.

In an exemplary method of the present invention, a contact lens is packaged in a blister package. The blister package comprises a body, a flexible top, and a lens cradle. The body can have a body top surface and can comprise a handle and a well connected to the handle. The well has a perimeter and an inner sidewall defining a bottom surface. The bottom surface can be flat, concave, or otherwise curved. The flexible top is configured to contact the body top surface around the perimeter of the well. The flexible top has an inner surface and, once sealed to the body, a peel tab that is peelable away from the body to open the well. The lens cradle can be of the kind described above. The lens cradle can be attached to the inner surface of the flexible top and can comprise a lens support bowl. The lens support bowl can have an opening along a side thereof between an edge of the lens support bowl and the inner surface of the flexible top. The lens support bowl can be shaped and sized to fit within the well and can be disposed between the body and the flexible top. The lens support bowl can have an inner bowl surface, for example, a concave inner bowl surface, and a cradle volume can be defined between the inner bowl surface and the inner surface of the flexible top. According to the method, a contact lens is placed in the cradle volume. Then, the flexible top is sealed to the body top surface to seal the cradle with the contact lens in the well. The method can further comprise pulling the flexible top away from the body top surface to lift the lens cradle away from the well. The flexible top can be pulled away from the body top surface in a direction, for example, from the handle toward the well, to lift the lens cradle away from the well.

The lens support bowl can be provided with a plurality of drainage through-holes and the method can further comprise peeling the flexible top away from the body top surface to lift the cradle away from the bottom surface of the well, and draining contact lens solution from the cradle, through the drainage through-holes. The contact lens solution can be drained into, and caught by, the well. The cradle volume can be made large enough to accommodate a major portion of a contact lens and the method can involve placing a major portion of a contact lens in the cradle volume before sealing the flexible top.

The blister package body includes a well for containing a contact lens immersed in an amount of a solution. The term "contact lens" as used herein is intended to embrace an ophthalmic lens which, after its removal from a mold assembly in which it is made, is of a structure, size, shape and power that it can be worn on or in the eye of an individual. The top surface of the blister package body includes a peripherally located perimeter region at least partially surrounding an opening of the well. The handle can include a grip region. The flexible top is designed to cover and sealingly enclose the contact lens and solution within the well.

The body of the blister package can be formed of a plastic material that can be shaped by injection molding or thermoforming. The plastic material used to make the body can comprise polypropylene, polyethylene, polystyrene, or another thermoplastic material. One or more portions of the body material, particularly in the well, can have a vapor transmission of less than 10 grams/100 square inches/24 hours at 70° F. and 50 percent relative humidity.

As stated above, the body of the blister package can comprise a variety of structures, such as a relatively rigid material or a flexible material. The base member of the sealed blister package can be a thermoplastic material and the base member can include a well and a substantially planar body top surface surrounding the well. The substantially planar body top surface provides a sealing surface for sealing the flexible top. The body can be made from a variety of materials. The body can be formed using conventional methods and equipment, such as by injection molding polypropylene resin into body molds in an injection molding machine. The flexible top can also be formed from a variety of materials. For example, the flexible top can be a laminated structure comprising a foil and one or more layers of plastic, such as polypropylene and the like. The flexible top can include human readable information, as desired. The flexible top can be coupled to the body top surface by contacting the sealing surface of the body with the flexible top and applying heat to fuse the two members together to provide a hermetic or airtight seal for the contact lens and the packaging solution in the well. The lid can comprise a rigid material and the cradle can be molded into the lid rather than being formed as a separate unit. The lid and the cradle can be co-molded, for example, co-extruded, co-injected, or the like. The lid and the cradle can be co-molded, for example, of different materials or of the same material. The lid can comprise a greater thickness of the same material as is used to form the cradle, and the greater thickness can afford greater rigidity to the lid relative to the cradle. The lid and the cradle can be formed integrally of the same material, as a one-piece and/or monolithic structure.

The perimeter of the well can be contiguous with the circumference of the well. The perimeter can include a flange region, for example, extending about 5 mm from the opening of the well to a grip region. In an exemplary embodiment, the overall dimensions of the blister package can be approximately 30 mm wide, about 47 mm long and about 10 mm high. It should be appreciated, however, that the package can have any size and/or shape.

The well holds in a fluid tight manner, a contact lens and solution. The well is bounded by a seal area that is part of the flange region. The flexible top can be attached to the body by heat-sealing in the seal area; however, induction-sealing, sonic welding, or other bonding systems can be used to attach the flexible top to the body. The total interior volume defined by the well, once sealed, can be about 2.2 ml or less. The volume of packaging solution in the bowl can be, for example, from about 0.5 ml to about 2.5 ml.

The flexible top can comprise at least two elements, for example, at least two different, separate layers of material. For example, the flexible top can comprise a first member, or first layer, and a second member, or second layer overlaying the first member. The first member can be made of a laminate material that is heat sealed to the seal region of the blister package body. The second member can comprise a foil material, sealed to the rim portion of the body. The second member can comprise at least one, for example two, polymer layers, e.g. polypropylene, coating the foil. The foil can comprise aluminum. The polymer coating material on the heat seal side of the foil can be polypropylene. Examples of useful cover layers are described in U.S. Pat. No. 4,691,820 that is incorporated herein in its entirety by reference. The second member can be sealed to the body along an entire circumference of the body surrounding the well, so as to provide a sanitary or sterile covering, for example, by means of a hermetic seal. The cradle can likewise be made of any of these materials and can also comprise two different separate layers of material.

An unworn contact lens is sealed within the well of the sealed contact lens blister package and is packaged in a contact lens packaging solution. Any contact lens can be packaged therein. For example, the contact lens can be a hydrogel contact lens or it can be a silicone hydrogel contact lens. Examples of contact lenses that can be provided in the packages include those having the following United States Adopted Names (USANs): methafilcon A, ocufilcon A, ocufilcon B, ocufilcon C, ocufilcon D, omafilcon A, omafilcon B, comfilcon A, enfilcon A, stenfilcon A, etafilcon A, senofilcon A, senofilcon B, senofilcon C, narafilcon A, narafilcon B, balafilcon A, samfilcon A, lotrafilcon A, lotrafilcon B, somofilcon A, riofilcon A, delefilcon A, and the like.

The fluid medium or solution contained in the well can be any known solution useful for storing contact lenses including water, saline solutions, or buffered aqueous solutions. The contact lens and solution will preferably fill at least 50 percent, for example, at least 70 percent or at least 80 percent, of the total volume defined by the well once sealed by the flexible top.

The contact lens packaging solution is typically a buffered saline solution, such as a phosphate buffered saline solution or a borate buffered saline solution, that can contain one or more additives, such as surfactants, wetting agents, viscosity agents, and the like.

The blister package can also include a wrap that has one or more panels. The wrap can be dimensioned to accommodate the sealed contact lens package and to also provide a UDI in both human readable form and machine-readable form, in addition to other required regulatory information. As used herein, a UDI is a "Unique Device Identifier". As used herein, a wrap refers to a substrate or article comprising one or more panels coupled to a sealed contact lens package, and a UDI in both human readable form and machine-readable form is provided on at least one of the panels. Such a wrap can be understood to be a "UDI wrap", or it can be understood to be a wrap having a "UDI panel". Thus, the wrap includes human readable information, such as letters, numbers, and images; and the wrap includes machine readable information, such as bar codes and the like. The wrap can be flexible or rigid and does not need to fully enclose or surround the individual sealed contact lens package. The wrap is coupled to the sealed contact lens package so that the wrap and sealed contact lens package do not become separated until a person opens the package to remove the unworn contact lens. For example, the wrap can be adhered to the sealed contact lens package, such as by using an adhesive between a surface of the wrap and a surface of the sealing member, or the wrap can be physically wrapped around the sealed contact lens package to mechanically enclose the sealed contact lens package within the wrap. Thus, the wrap cannot be inadvertently dislodged or separated from the sealed contact lens blister package.

Examples of blister package materials, methods of making blister package bodies, flexible tops, methods of making flexible tops, methods of sealing flexible tops to bodies, as well as other helpful components, materials, methods, and systems are described, for example, in U.S. Pat. Nos. 6,398,018, 7,426,993 B2, and 7,477,366 B2, in U.S. Patent Application Publications Nos. US 2012/0061260 A1, and US 2017/0096272 A1, and in WO 2013/160667, each of which is incorporated herein in its entirety by reference.

With reference to the drawing figures, FIG. 1A illustrates two sequential steps involved with opening a blister pack 20 according to an exemplary embodiment of the present invention. With regard to FIG. 1B, the same reference numerals as are used in FIG. 1A denote the same features as are shown in FIG. 1A. FIG. 1A shows the same single blister pack 20 at two different points of time during an opening procedure, and FIG. 1B also shows the same blister package 20 at an even later point in time during the opening procedure. To the left in FIG. 1A is a new, unopened, and unpeeled blister package 22. Blister package 22 comprises a body 24 and a flexible top 28 sealing a contact lens within a well 32.

Flexible top 28 is sealed against a top surface 38 of body 24. Body 24 defines well 32 and a handle 34. Handle 34 extends away from well 32 and curves downwardly at a distal portion terminating in a distal end 35. On the bottom of body 24, a rim 33 is provided to stabilize blister package 20 and enable the blister package to sit flat on a flat surface, for example, such that, if opened, contact lens solution would not spill out of well 32.

Figure 1B:
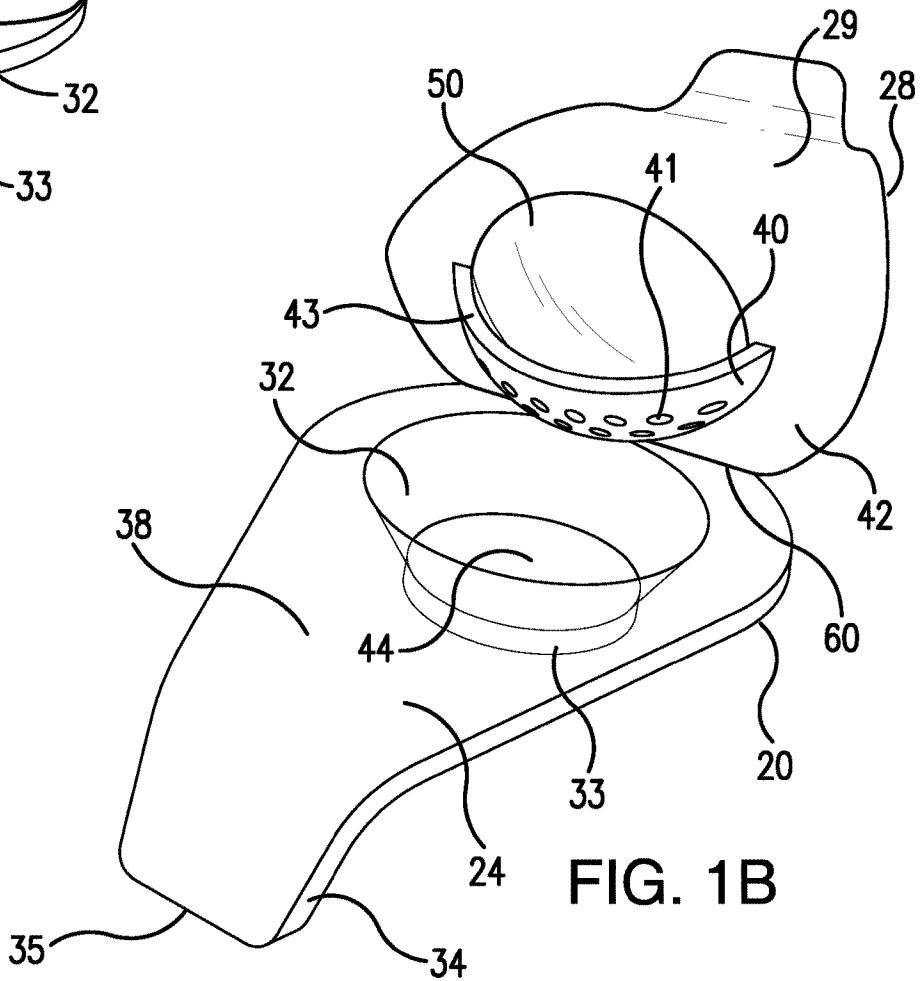
FIG. 1B shows the blister package shown in FIG. 1A opened with the lens cradle, cradling a contact lens, lifted out of the well.

In the third state shown, in FIG. 1B, flexible top 28 has been almost fully, but not completely, removed from top surface 38 of body 24. As can be seen in FIG. 1B, a lens cradle 40 is attached to an inner surface 29 of flexible top 28. Lens cradle 40 includes a tab 42 and a lens support bowl 43. Tab 42 of lens cradle 40 is attached, or otherwise connected, as by adhesive or heat-bonding, to inner surface 29 of flexible top 28.

As shown to the right in FIG. 1A, as flexible top 28 is peeled away from top surface 38 of body 24, in a direction from handle 34 toward well 32, lens cradle 40 is lifted out of well 32, attached to inner surface 29, and carries with it, out of well 32, contact lens 50. The lifting can continue until flexible top 28 reaches a pivot line 60 where flexible top 28 is still attached to top surface 38 but lens support bowl 43 presents lens 50 in an orientation that enables easy manipulation of lens 50, for example, enabling unobstructed contact with a user's fingertip. At the state shown in FIG. 1B, contact lens solution, in which contact lens 50 had been immersed in well 32, drains out of lens support bowl 43 through through-holes 41 formed in lens support bowl 43. The contact lens solution drains into well 32. Contact lens solution can be drained back into the well through through-holes 41 and/or out of the opening to the lens support bowl. Accordingly, it can be preferred to make sure the flexible top is not completely removed from top surface 38 of body 24 so that lens support bowl 43 and drainage through-holes 41 remain aligned with well 32 and well 32 can capture the draining contact lens solution.

As can be seen in FIG. 1B, cradle tab 42 has a greater area contacting inner surface 29 of flexible top 28 than the area of lens support provided by lens support bowl 43. Tab 60 can extend all the way to the edge of the inner surface 29 of flexible top 28, as shown in FIG. 1B, or can extend partially toward the edge of the inner surface 29 of flexible top 28. Either way, the surface of tab 60 shown exposed in FIG. 1B can be adhered or heat-bonded to top surface 38 of body 24 and to inner surface 29 of flexible top 28. As can also be seen in FIG. 1B, lens support bowl 43 can support about 50% of contact lens 50 and is of hollow half-hemispherical shape.

Figure 2:
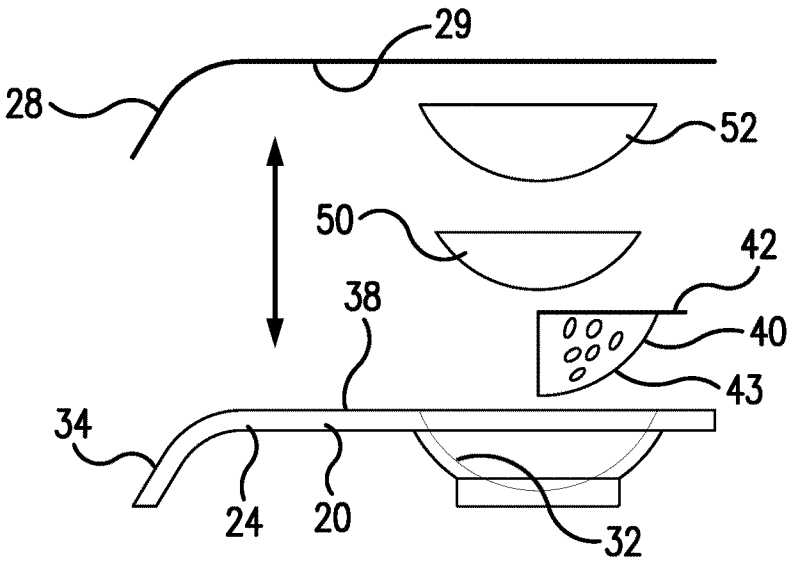
FIG. 2 is an exploded view of an unopened blister package as shown in FIG. 1A, including the contact lens and contact lens solution contained therein.

FIG. 2 is an exploded view of blister package 20, showing flexible top 28 lifted away from body 24, lens cradle 40 lifted out of well 32 and disconnected from inner surface 29 of flexible top 28, and showing contact lens 50 and an aliquot of contact lens solution 52 that, in the constructed blister package, would be accommodated by well 32. In FIG. 2, the same reference numerals as are used in FIGS. 1A and 1B denote the same features as are shown in FIGS. 1A and 1B. As can be seen, the volume defined by the inner surface of lens support bowl 43, referred to herein as the cradle volume, is of sufficient dimensions to accommodate about half of contact lens 50.

Figure 3B:
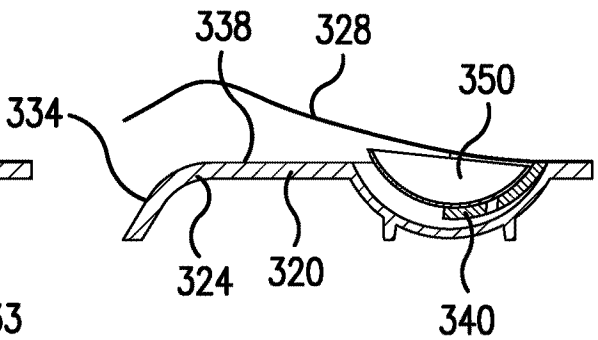
FIGS. 3A-3C show a series of three steps involved with opening a blister package according to an embodiment of the present invention.
Figure 3C:
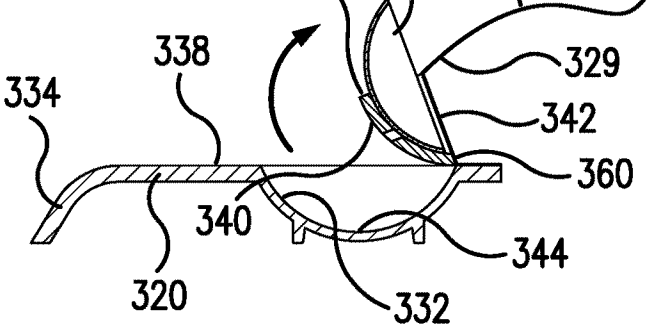
Figure 3A:
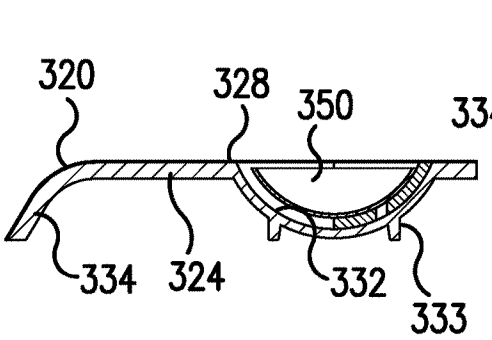

FIGS. 3A-3C show a sequential series of steps involved with opening a blister package according to embodiments of the present invention. As can be seen in FIG. 3A, a new, unopened, and unpeeled blister package 320 comprises a body 324 and a flexible top 328 sealing a contact lens 350 within a well 332. Flexible top 328 is sealed against a top surface of body 324. Body 324 defines well 332 and a handle 334. Handle 334 extends away from well 332 and curves downwardly at a distal portion terminating in a distal end 35. On the bottom of body 324, a rim 333 is provided to stabilize blister package 320 and enable the blister package to sit flat on a flat surface.

In the second state shown in FIG. 3B, flexible top 328 has been slightly removed from top surface 338 of body 324, with removal occurring in a direction from handle 334 toward well 332. As can be seen in FIG. 3C, a lens cradle 340 is attached to an inner surface 329 of flexible top 328. Lens cradle 340 includes a lens support bowl 343. A tab 342 of lens cradle 340 is attached, or otherwise connected, as by adhesive or heat-bonding, to inner surface 329 of flexible top 328. Tab 342 stiffens flexible top 328 and provides a pivot line at which peeled-away flexible top 328 bends back to substantially expose and provide access to contact lens 350 protruding from lens support bowl 343. Flexible top 328 can also pivot about a pivot line 360 where flexible top remains attached to top surface 338 of body 324.

In the position shown in FIG. 3C, contact lens 350 can be pinched and removed from lens support bowl 343 or contacted, on its convex surface, with a fingertip and drawn out of lens support bowl 343. As can also be discerned, contact lens solution can drain from lens support bowl 343 through drainage through-holes formed in lens support bowl 343 and drip or run into well 332. Although a bottom 344 of well 332 is shown curved, it is also to be understood that bottom 344 and well 332 can have other shapes.

The present invention includes the following aspects/embodiments/features in any order and/or in any combination:

1. A blister package for a contact lens, the blister package comprising:

a body, the body having a body top surface and comprising a handle and a well connected to the handle, the well having a perimeter and an inner sidewall defining a bottom surface;

a flexible top contacting the body top surface around the perimeter of, and closing, the well, the flexible top having an inner surface and a peel tab and being peelable away from the body to open the well; and a lens cradle attached to the inner surface of the flexible top, comprising a lens support bowl, and having an opening along a side thereof between an edge of the lens support bowl and the inner surface of the flexible top, wherein the lens support bowl is shaped and sized to fit within the well, is disposed between the body and the flexible top, and has an inner bowl surface, wherein a cradle volume is defined between the inner bowl surface and the inner surface of the flexible top and is configured to accommodate a portion of a contact lens, and the lens cradle and flexible top are configured such that, by pulling the flexible top away from the body top surface, the lens cradle is lifted away from the bottom surface of the well.
2. The blister package of any preceding or following embodiment/feature/aspect, wherein the inner bowl surface is concave.
3. The blister package of any preceding or following embodiment/feature/aspect, wherein the lens support bowl comprises a plurality of drainage through-holes.
4. The blister package of any preceding or following embodiment/feature/aspect, wherein the cradle volume is large enough to accommodate a major portion of a contact lens.
5. The blister package of any preceding or following embodiment/feature/aspect, wherein the lens cradle comprises a tab portion attached to the lens support bowl and adhered to the inner surface of the flexible top.

6. The blister package of any preceding or following embodiment/feature/aspect, wherein the lens support bowl has a hollow, substantially hemispherical shape.
7. The blister package of any preceding or following embodiment/feature/aspect, wherein the lens support bowl has a shape defined by a portion of a hollow hemisphere.
8. The blister package of any preceding or following embodiment/feature/aspect, wherein the lens support bowl has a shape comprising from about 50% to about 75% of a hemisphere.
9. The blister package of any preceding or following embodiment/feature/aspect, wherein each of the flexible top and the lens cradle independently comprises a foil material.
10. The blister package of any preceding or following embodiment/feature/aspect, wherein the flexible top further comprises a peel tab that contacts the body on a first side of the well, and a hinge is connected to the flexible top adjacent a second side of the well, the second side being opposite the first side.
11. The blister package of any preceding or following embodiment/feature/aspect, wherein and the blister package is configured such that, by peeling the flexible top away from the body to expose the well, the lens cradle is lifted away from the bottom surface of the well.
12. The blister package of any preceding or following embodiment/feature/aspect, further comprising a contact lens in the cradle volume.
13. A method of packaging a contact lens in a blister package, the blister package comprising a body, the body having a body top surface and comprising a handle and a well connected to the handle, the well having a perimeter and an inner sidewall defining a bottom surface, a flexible top configured to contact the body top surface around the perimeter of the well, the flexible top having an inner surface and, once sealed to the body, a peel tab being peelable away from the body to open the well, and a lens cradle attached to the inner surface of the flexible top, comprising a lens support bowl, and having an opening along a side thereof between an edge of the lens support bowl and the inner surface of the flexible top, wherein the lens support bowl is shaped and sized to fit within the well, is disposed between the body and the flexible top, and has an inner bowl surface, and a cradle volume is defined between the inner bowl surface and the inner surface of the flexible top, the method comprising:

placing a contact lens in the cradle volume; and sealing the flexible top to the body top surface to seal the cradle with the contact lens, in the well.

14. The method of any preceding or following embodiment/feature/aspect, further comprising pulling the flexible top away from the body top surface to lift the lens cradle away from the well.
15. The method of any preceding or following embodiment/feature/aspect, further comprising pulling the flexible top away from the body top surface in a direction from the handle toward the well to lift the lens cradle away from the well.
16. The method of any preceding or following embodiment/feature/aspect, wherein the inner bowl surface is concave.
17. The method of any preceding or following embodiment/feature/aspect, wherein the lens support bowl comprises a plurality of drainage through-holes and the method comprises peeling the flexible top away from the body top surface to lift the cradle away from the bottom surface of the well, and draining contact lens solution from the cradle, through the drainage through-holes.
18. The method of any preceding or following embodiment/feature/aspect, wherein the cradle volume accommodates a major portion of the contact lens.

The present invention can include any combination of these various features or embodiments above and/or below as set-forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof

What is claimed is:

1. A blister package for a contact lens, the blister package comprising:

a body, the body having a body top surface and comprising a handle and a well connected to the handle, the well having a perimeter and an inner sidewall defining a bottom surface;

a flexible top contacting the body top surface around the perimeter of, and closing, the well, the flexible top having an inner surface and a peel tab and being peelable away from the body to open the well; and a lens cradle attached to the inner surface of the flexible top, comprising a lens support bowl, and having an opening along a side thereof between an edge of the lens support bowl and the inner surface of the flexible top, wherein the lens support bowl is shaped and sized to fit within the well, is disposed between the body and the flexible top, and has an inner bowl surface, wherein a cradle volume is defined between the inner bowl surface and the inner surface of the flexible top and is configured to accommodate a portion of a contact lens, and the lens cradle and flexible top are configured such that, by pulling the flexible top away from the body top surface, the lens cradle is lifted away from the bottom surface of the well.

2. The blister package of claim 1, wherein the inner bowl surface is concave.

3. The blister package of claim 1, wherein the lens support bowl comprises a plurality of drainage through-holes.

4. The blister package of claim 1, wherein the cradle volume is large enough to accommodate a major portion of a contact lens.

5. The blister package of claim 1, wherein the lens cradle comprises a tab portion attached to the lens support bowl and adhered to the inner surface of the flexible top.

6. The blister package of claim 1, wherein the lens support bowl has a hollow hemispherical shape.

7. The blister package of claim 1, wherein the lens support bowl has a shape defined by a portion of a hollow hemisphere.

8. The blister package of claim 1, wherein the lens support bowl has a shape comprising from about 50% to about 75% of a hemisphere.

9. The blister package of claim 1, wherein each of the flexible top and the lens cradle independently comprises a foil material.

10. The blister package of claim 1, wherein the flexible top further comprises a peel tab that contacts the body on a first side of the well, and a hinge is connected to the flexible top adjacent a second side of the well, the second side being opposite the first side.

11. The blister package of claim 1, wherein and the blister package is configured such that, by peeling the flexible top away from the body to expose the well, the lens cradle is lifted away from the bottom surface of the well.

12. The blister package of claim 1, further comprising a contact lens in the cradle volume.

13. A method of packaging a contact lens in a blister package, the blister package comprising a body, the body having a body top surface and comprising a handle and a well connected to the handle, the well having a perimeter and an inner sidewall defining a bottom surface, a flexible top configured to contact the body top surface around the perimeter of the well, the flexible top having an inner surface and, once sealed to the body, a peel tab being peelable away from the body to open the well, and a lens cradle attached to the inner surface of the flexible top, comprising a lens support bowl, and having an opening along a side thereof between an edge of the lens support bowl and the inner surface of the flexible top, wherein the lens support bowl is shaped and sized to fit within the well, is disposed between the body and the flexible top, and has an inner bowl surface, and a cradle volume is defined between the inner bowl surface and the inner surface of the flexible top, the method comprising:

placing a contact lens in the cradle volume; and sealing the flexible top to the body top surface to seal the cradle with the contact lens, in the well.

14. The method of claim 13, further comprising pulling the flexible top away from the body top surface to lift the lens cradle away from the well.

15. The method of claim 13, further comprising pulling the flexible top away from the body top surface in a direction from the handle toward the well to lift the lens cradle away from the well.

16. The method of claim 13, wherein the inner bowl surface is concave.

17. The method of claim 13, wherein the lens support bowl comprises a plurality of drainage through-holes and the method comprises peeling the flexible top away from the body top surface to lift the cradle away from the bottom surface of the well, and draining contact lens solution from the cradle, through the drainage through-holes.

18. The method of claim 13, wherein the cradle volume accommodates a major portion of the contact lens.

* * * * *